US006945053B2

(12) United States Patent
Von Der Bank

(10) Patent No.: US 6,945,053 B2
(45) Date of Patent: Sep. 20, 2005

(54) LEAN PREMIX BURNER FOR A GAS TURBINE AND OPERATING METHOD FOR A LEAN PREMIX BURNER

(75) Inventor: Ralf Sebastian Von Der Bank, Rangsdorf (DE)

(73) Assignee: Rolls Royce Deutschland Ltd & Co KG, Blankenfelde-Mahlow (DE)

( * ) Notice: Subject to any disclaimer, the term of this patent is extended or adjusted under 35 U.S.C. 154(b) by 0 days.

(21) Appl. No.: 10/316,936

(22) Filed: Dec. 12, 2002

(65) Prior Publication Data

US 2003/0106321 A1 Jun. 12, 2003

(30) Foreign Application Priority Data

Dec. 12, 2001 (DE) ..... 101 60 997

(51) Int. Cl.[7] ..... F02C 7/22; F02C 7/26

(52) U.S. Cl. ..... 60/776; 60/773; 60/737; 60/734; 60/739

(58) Field of Search ..... 60/773, 737, 39.21, 60/734, 739, 740, 746, 747, 776

(56) References Cited

U.S. PATENT DOCUMENTS

| | | | | | |
|---|---|---|---|---|---|
| 2,616,258 | A | * | 11/1952 | Mock | 60/743 |
| 4,027,473 | A | * | 6/1977 | Baker | 60/39.281 |
| 4,222,243 | A | | 9/1980 | Mobsby | |
| 4,817,389 | A | * | 4/1989 | Holladay et al. | 60/739 |
| 4,903,478 | A | * | 2/1990 | Seto et al. | 60/39.281 |
| 5,211,005 | A | * | 5/1993 | Hovnanian | 60/800 |
| 5,226,287 | A | * | 7/1993 | Ng | 60/39.281 |
| 5,303,542 | A | * | 4/1994 | Hoffa | 60/773 |
| 5,321,949 | A | | 6/1994 | Napoli et al. | |
| 5,351,477 | A | | 10/1994 | Joshi et al. | |
| 5,402,634 | A | * | 4/1995 | Marshall | 60/776 |
| 5,699,667 | A | | 12/1997 | Joos | |
| 5,778,676 | A | | 7/1998 | Joshi et al. | |
| 5,862,668 | A | * | 1/1999 | Richardson | 60/737 |
| 5,884,483 | A | * | 3/1999 | Munro | 60/739 |
| 5,899,075 | A | | 5/1999 | Dean et al. | |
| 6,109,038 | A | | 8/2000 | Sharifi et al. | |
| 6,161,387 | A | | 12/2000 | Green | |
| 6,189,321 | B1 | * | 2/2001 | Banhardt et al. | 60/739 |
| 6,370,863 | B2 | * | 4/2002 | Muller et al. | 60/776 |

FOREIGN PATENT DOCUMENTS

| | | |
|---|---|---|
| DE | 4446945 | 7/1996 |
| EP | 0527629 | 2/1993 |
| EP | 1058063 | 12/2000 |
| EP | 1288575 | 3/2003 |
| WO | 02061339 | 8/2002 |

* cited by examiner

*Primary Examiner*—William H. Rodriguez
(74) *Attorney, Agent, or Firm*—Harbin King & Klima

(57) ABSTRACT

A lean premix burner for a gas turbine having at least one fuel supply ring 4 fitted with primary fuel nozzles 8 and additional secondary fuel nozzles 9, and a method of operation for this lean premix burner.

22 Claims, 3 Drawing Sheets

LEAN PREMIX BURNER FOR A GAS TURBINE AND OPERATING METHOD FOR A LEAN PREMIX BURNER

This application claims priority to German Patent Application DE10160997.3, filed Dec. 12, 2001, the entirety of which is incorporated by reference herein.

BACKGROUND OF THE INVENTION

The invention comprises a lean premix burner for a gas turbine and a method of operating a lean premix burner.

In detail, the invention comprises a lean premix burner with at least one fuel supply ring featuring primary fuel nozzles.

Such a lean premix burner can be realized as either an LPP module or a swirlcup.

Lean premix burners are known as state-of-the-art technology in a wide variety of designs and versions.

Lean premix burners were developed, among other reasons, to avoid formation of nitrous oxides. For this purpose, the air-to-fuel ratio is set high so as to realize a very lean mixture in this process. This results in relatively low burning temperatures in the main burning zone.

A potential drawback may result from the fact that the relatively low combustion temperatures lead to less complete combustion than at higher temperatures, resulting in unburned hydrocarbon and carbon monoxide emissions.

A further disadvantage is that the very lean mixture results in a combustion process that cannot be adjusted to much greater leanness under normal conditions without destabilizing the process. Setting the mixture leaner would finally result in a flame going out. This means that so-called pilot burners must be installed to ensure safe and air-worthy operation. These pilot burners ensure a high local combustion temperature. This, in turn, results in a high level of flame stability. A disadvantage to pilot burner operation is the relatively high level of resulting $NO_X$ emissions.

State-of-the-art technology comprises use of these pilot burners in axially staged combustion chambers used in combination with lean premix burners. Such combustion chambers are relatively large, feature a complex geometry and have a large surface requiring cooling.

BRIEF SUMMARY OF THE INVENTION

The invention is intended to accomplish the task of creating a lean premix burner and a method of operating a lean premix burner which in simple arrangement at sub-state-of-the-art level result in low thermal load levels and reliable combustion even under very lean conditions.

According to the invention, the task is realized as to the lean premix burner by the combination of features described herein; as to the method, the task is realized by the combination of features described herein. Further advantageous versions of the invention are describer below.

As to the lean premix burner, the intention is thus to place additional secondary fuel nozzles beside the primary fuel nozzle ring.

The lean premix burner according to the invention features a number of considerable advantages.

The additional secondary fuel nozzles make is possible to enrich the fuel-air mixture locally. It is therefore not necessary to install additional pilot burners or similar devices. Instead, according to the invention there are areas at the fuel nozzle ring where a richer fuel-air mixture is present. This results in higher-temperature combustion at the flame root and thus in a more stable flame. This in turn results in a more stable operation of the lean premix burner and the risk of a flame going out is reliably avoided. In a particularly advantageous version of the invention, the primary fuel nozzles are distributed evenly around the circumference of the fuel supply ring and the secondary fuel nozzles are distributed unevenly around the circumference. It is particularly advantageous to locate the secondary fuel nozzles in only a few sectors around the fuel nozzle ring. This facilitates supply of a richer mixture to individual areas/sectors around the fuel nozzle ring.

According to the invention, there is thus an internal staging of fuel feed flow around the fuel supply ring. The invention thus switches and controls the fuel feed such that at some operating points at low load levels, additional adjacent secondary fuel nozzles are put into operation to enrich the fuel-air mixture, i.e. adjacent to at least two primary fuel nozzles.

To maintain a constant total fuel flow at each gas turbine load point, the invention switches off other primary fuel nozzles that are not needed.

When the switchover from low load operation to full load operation occurs, a continuous rise in the fuel mass flow is ensured by switching primary fuel nozzles back on accordingly. The secondary fuel nozzles which are then no longer required are blown out accordingly.

To ensure safe and reliable operation in low load ranges as well, it may be advantageous to have additional mini-nozzles at the fuel nozzle ring. These fuel mini-nozzles can be arranged in groups or clusters.

The method according to the invention thus facilitates a richer air-fuel mixture at local points around the fuel supply ring and no fuel feed to other sectors at the fuel supply ring. As was mentioned above, the total fuel flow supplied to the lean premix burner remains essentially the same.

The invention thus realizes a higher level of flame stability in the lean premix burner so that additional pilot burners are not required at all. This reduces combustion chamber volume. The surface area of the combustion chamber is also reduced, hence also reducing the cooling air required. Furthermore, this results in increased gas turbine operating efficiency.

Another essential advantage of the invention is facilitation of a continuous transition from full load operation to lower or low load operation. The discontinuous fuel staging between pilot burners and lean premix burners known from state-of-the-art technology, and the systems required to realize it, are not required at all when the invention is used. This in turn results in improved thrust behavior when the gas turbine switches back and forth between the different load ranges.

BRIEF DESCRIPTION OF THE DRAWINGS

Embodiments of the invention are described below in reference to the numbered drawings, wherein.

DETAILED DESCRIPTION OF THE INVENTION

For easy reference, the parts have been labeled with the same numbers in the different versions of the invention.

This detailed description should be read in conjunction with the summary of the invention above.

Figure 1:
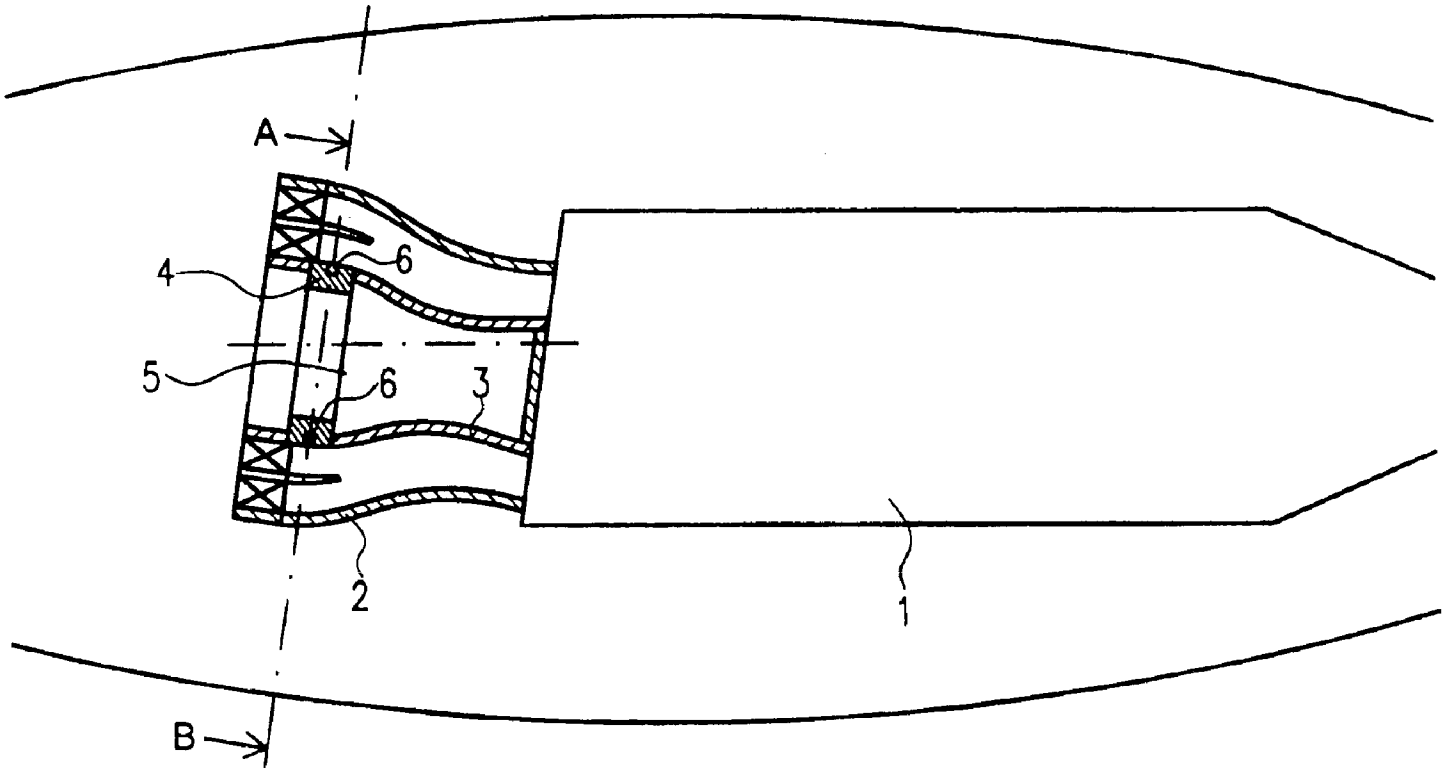
FIG. 1 shows a simplified image of a lean premix burner in a gas turbine combustion chamber.

FIG. 1 shows a schematic lateral view of a lean premix module according to the invention in a gas turbine combustion chamber. Reference number 1 indicates a flame tube installed downstream from a lean premix burner; the burner consists of an outer casing 2 and an inner casing 3. The inner casing features a fuel nozzle ring 4. Reference number 5 indicates an internal structural element of the lean premix burner. Reference number 6 indicates the position of fuel nozzles in a generalized presentation.

The basic design and construction of such lean premix burners is known from state-of-the-art technology and therefore requires no further detailing here.

Figure 2:
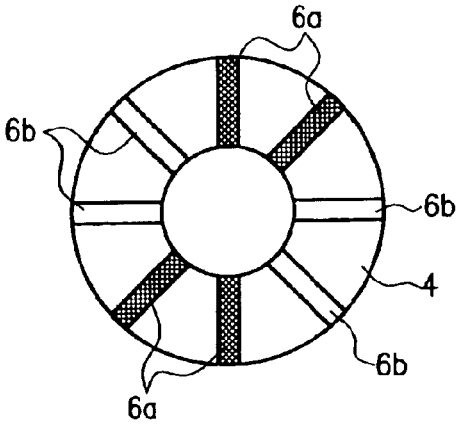
FIG. 2 shows a generalized view along the line A–B in FIG. 1 demonstrating the arrangement of the primary nozzles along the circumference.

FIG. 2 shows a sectional view along line A-B in FIG. 1. Several fuel nozzles 6 are shown schematically in the fuel supply ring 4. The fuel supply systems and other such details are not shown. FIG. 2 shows that some of the fuel nozzles 6 are in operation, namely the fuel nozzles 6*a*, while the other fuel nozzles shown, 6*b*, are not in operation.

Figure 3:
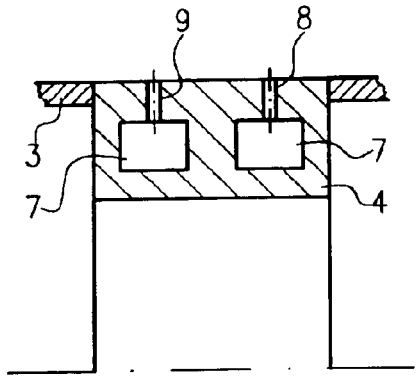
FIG. 3 shows an enlarged partial sectional view of a fuel nozzle ring according to the invention.

In FIG. 3 shows, at a higher magnification, a section through a version of the fuel supply ring 4 according to the invention. The ring comprises two fuel distribution ducts 7, each of which is connected to several primary fuel nozzles 8 and secondary fuel nozzles 9 along the circumference. FIG. 3 shows that the primary fuel nozzles 8 and the secondary fuel nozzles 9 each have their own fuel feed ducts 7, facilitating a variability of the fuel supply.

Figure 4:
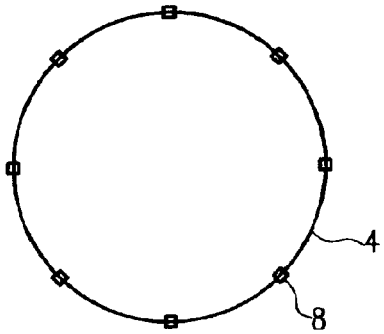
FIG. 4 shows a highly simplified schematic frontal view of a fuel supply ring with even distribution of the primary fuel nozzles.
Figure 5:
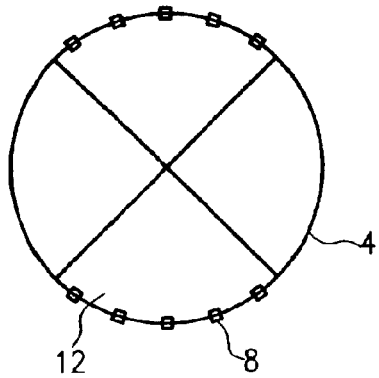
FIG. 5 shows a view analogous to FIG. 4 under conditions of part or low load operation.

FIGS. 4 and 5 show (highly simplified) frontal views of the arrangement of the fuel nozzles along the circumference of the fuel supply ring 4. FIG. 4 shows the individual primary fuel nozzles 8 distributed evenly along the circumference an in operation accordingly. FIG. 5, on the other hand, shows a total of four fuel nozzle sectors with different arrangements of secondary fuel nozzles 9 distributed unevenly along the circumference. The fact that the primary fuel nozzles 8 and the secondary fuel nozzles 9 are positioned at different levels (see FIG. 3) results in the arrangement of the secondary fuel nozzles 9 shown in FIG. 5.

Figure 6:
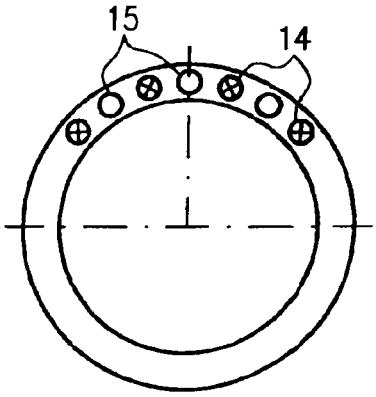
FIG. 6 shows a view analogous to FIGS. 4 and 5 with lean premix burners switched in various configurations.
Figure 7:
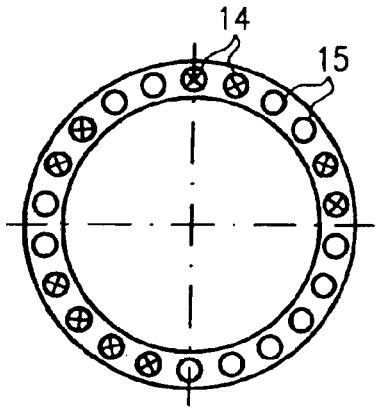
FIG. 7 shows a further variation on FIG. 6.

FIGS. 6 and 7 show, in a simplified, schematic presentation, different arrangements of lean premix burners along the circumference of a single annular combustor. FIG. 6 shows a symmetrical circumference pattern in which the lean premix modules 14 in operation alternate with lean premix modules 15 not in operation. FIG. 7, on the other hand, shows an asymmetrical arrangement along the circumference of a single annular combustor (clustered circumference switching). Here, several adjacent lean premix modules 14 are in operation (hatching) while next to them several lean premix modules 15 are not in operation (no hatching).

Figure 8:
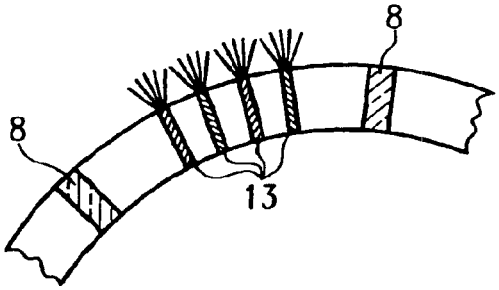
FIG. 8 shows a sectional view similar to FIG. 2 with the intention of showing the fuel mini-nozzles.

FIG. 8 shows a sectional view similar to FIG. 2 in which, in addition, fuel mini-nozzles 13 are arranged in a cluster at the fuel supply ring 4. These fuel mini-nozzles 13 feature a higher fuel injection velocity, resulting in a richer local fuel-air mixture. Adjacent to the fuel mini-nozzles 13, primary fuel nozzles 8 are shown schematically.

Figure 9:
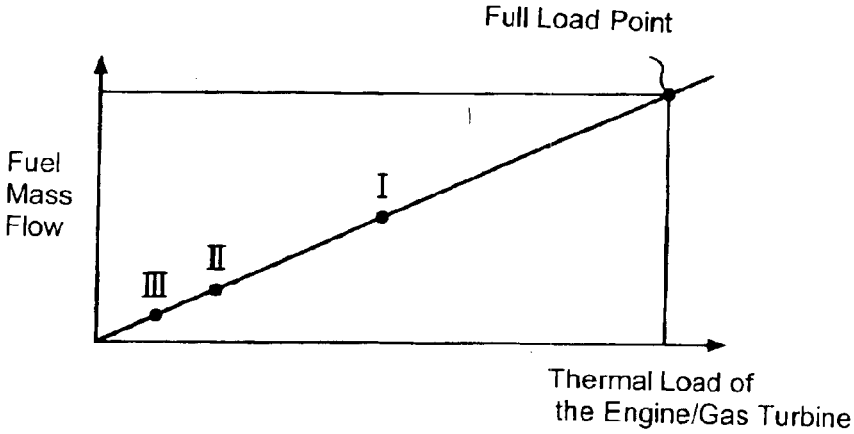
FIG. 9 shows an operational diagram of various load levels.

FIG. 9 shows a diagram plotting the fuel mass flow against the thermal load of the engine/gas turbine. The resulting straight-line runs from the zero point to the full load point. To ensure reliable operation and flame stability of the lean premix burners or lean premix modules in an annular combustion chamber, the burners are switched at three different levels of operating load, presented as follows.

The following description refers to a reduction of the engine output; however, the effect of a load increase would be analogous.

A switching point is intended at operating point I. At this point, circumferential staging of burners takes place, symmetrically or asymmetrically as described above. The burner modules or lean premix burners are thereby staged in such a way that the lean premix burners or modules will reach their thermal capacity of approximately 100% at staging point I. The staging procedure is realized by means of valves, whereby switches or regulated valves can be used.

At a medium-load operating point II, which can be at about half of the thermal combustor load of the first point I, groups of injection nozzles on the lean premix burners or lean modules that had heretofore remained in operation are switched off. This ensures further operation of the existing fuel injection nozzles at 100% (at the staging point) of the individual burner fuel mass flow. A particular advantage in this low load range can be attained by means of an asymmetrical arrangement of the fuel nozzles remaining in operation (asymmetrical cluster switching).

At the third operating point III the load has been further reduced and a switchover from the normal nozzles (primary fuel nozzles and secondary fuel nozzles) to clusters of mini-nozzles or a secondary nozzle ring takes place. These mini-nozzles have—as described—a much smaller diameter than the normal nozzles. The mini-nozzles/secondary nozzles produce acceptable fuel atomization at low load levels accompanied by a comparatively improved droplet evaporation behavior, while still producing a relatively rich air-fuel mixture locally. The improved fuel atomization and improved droplet evaporation are also advantageous and important since within the low load range of the gas turbine the compressor delivery temperature is low compared to full load operation. The invention thus produces a spray mixture and ensures flame stability.

It must be noted that the invention therefore also comprises grouping of individual modules of lean premix burners in an annular combustion chamber so as to group together the lean premix burners in operation at low loads. Switching off some of the lean premix burners or modules results in richer mixtures generated by the remaining operating modules or lean premix burners at the same fuel mass flow to the combustion chambers. When the load is then to be further reduced it is possible, also in combination with the measures just described, to put additional secondary nozzles or mini-nozzles into operation so as to select individual areas in which (along the circumference) some sectors have an enriched fuel-air mixture. This ensures flame stability, etc., of the individual module or lean premix burner, as described above.

The invention is not limited to the versions shown here, but rather a wide variety of variations and modifications are possible within the framework of the invention. It is contemplated that the various features and characteristics of the present invention can be combined in different manners to create new embodiments.

What is claimed is:

1. A lean premix burner for a gas turbine, comprising:

at least one fuel supply ring, a circumference of the fuel supply ring having a plurality of uniformly sized sectors, the fuel supply ring including:

a plurality of primary fuel nozzles, all of which are distributed evenly along the circumference of the fuel supply ring, and a plurality of additional secondary fuel nozzles distributed unevenly along the circumference of the fuel supply ring, wherein at least some of the sectors include only primary fuel nozzles and at least some of the remaining sectors include both primary fuel nozzles and secondary fuel nozzles.

2. A lean premix burner according to claim 1, wherein the fuel supply ring further comprises a plurality of fuel mini-nozzles.

3. A lean premix burner according to claim 2, wherein the fuel mini-nozzles are arranged in clusters.

4. A lean premix burner according to claim 3, wherein the fuel supply ring is constructed and arranged to generate richer air-fuel mixture by activation of least one the secondary fuel nozzles and the fuel mini-nozzles.

5. A lean premix burner according to claim 4, wherein the sectors are quadrants and the secondary fuel nozzles are positioned in only some of the quadrants.

6. A lean premix burner according to claim 1, wherein the sectors are quadrants and the secondary fuel nozzles are positioned in only some of the quadrants.

7. A method of operation of a lean premix burner for a gas turbine comprising at least one fuel supply ring including a plurality of primary fuel nozzles and a plurality of additional secondary fuel nozzles, the method comprising:

at low gas turbine load levels, enriching an air-fuel mixture locally at certain sectors around the fuel supply ring, providing fuel injection through the primary fuel nozzles in some sectors and stopping fuel injection through the primary fuel nozzles at other sectors around the fuel supply ring, while maintaining a total fuel mass flow to the lean premix burner essentially the same.

8. A method according to claim 7, and further comprising:

switching on at least secondary fuel nozzles adjacent to primary fuel nozzles at low gas turbine load levels to provide a locally enriched fuel-air mixture.

9. A method according to claim 8, and further comprising:

switching off primary fuel nozzles not arranged adjacent the secondary fuel nozzles.

10. A method according to claim 9, and further comprising:

locally supplying a richer fuel-air mixture through additional fuel mini-nozzles when the gas turbine load decreases further.

11. A method according to claim 10, and further comprising: staging the primary fuel nozzles, secondary fuel nozzles and fuel mini-nozzles in operation in local clusters along a circumference of the fuel supply ring.

12. A method according to claim 7, and further comprising:

switching off primary fuel nozzles not arranged adjacent the secondary fuel nozzles.

13. A method according to claim 12, and further comprising:

locally supplying a richer fuel-air mixture through additional fuel mini-nozzles when the gas turbine load decreases further.

14. A method according to claim 13, and further comprising: staging the primary fuel nozzles, secondary fuel nozzles and fuel mini-nozzles in operation in local clusters along a circumference of the fuel supply ring.

15. A method according to claim 7, and further comprising:

locally supplying a richer fuel-air mixture through additional fuel mini-nozzles when the gas turbine load decreases further.

16. A method according to claim 15, and further comprising: staging the primary fuel nozzles, secondary fuel nozzles and fuel mini-nozzles in operation in local clusters along a circumference of the fuel supply ring.

17. A lean premix burner for a gas turbine, comprising:

at least one fuel supply ring including:

a plurality of primary fuel nozzles, a plurality of additional secondary fuel nozzles, and a plurality of fuel mini-nozzles arranged in clusters along a circumference of the fuel supply ring such that the fuel mini-nozzles are distributed unevenly along the circumference of the fuel supply ring.

18. A lean premix burner according to claim 17, wherein the primary fuel nozzles are evenly distributed along circumference fuel supply ring and the secondary fuel nozzles are distributed unevenly along the circumference of the fuel supply ring.

19. A lean premix burner according to claim 18, wherein the secondary fuel nozzles are positioned in only some sectors of the fuel supply ring.

20. A lean premix burner according to claim 19, wherein the sectors are quadrants and the secondary fuel nozzles are positioned in only some of the quadrants.

21. A lean premix burner according to claim 20, wherein the fuel supply ring is constructed and arranged to generate a richer air-fuel mixture by activation of at least one of the secondary fuel nozzles and the fuel mini-nozzles.

22. A lean premix burner according to claim 17, wherein the secondary fuel nozzles are positioned in only some quadrants of the fuel supply ring.

* * * * *